US006992259B1

(12) United States Patent
Cantolino

(10) Patent No.: US 6,992,259 B1
(45) Date of Patent: Jan. 31, 2006

(54) MULTI-PURPOSE CONDENSATE SWITCH

(76) Inventor: Christopher Ralph Cantolino, 7704 - 18th Ave., NW., Bradenton, FL (US) 34209

( * ) Notice: Subject to any disclaimer, the term of this patent is extended or adjusted under 35 U.S.C. 154(b) by 0 days.

(21) Appl. No.: 11/060,976

(22) Filed: Feb. 19, 2005

(51) Int. Cl.
*H01H 35/18* (2006.01)

(52) U.S. Cl. ..... 200/84 R; 200/84 B

(58) Field of Classification Search ..... 200/84 R, 200/84 B; 417/36, 40, 53, 331
See application file for complete search history.

(56) References Cited

U.S. PATENT DOCUMENTS 4,631,001 A * 12/1986 Keech ..... 417/3
4,703,956 A * 11/1987 Keech ..... 285/133.3
5,006,044 A * 4/1991 Walker et al. ..... 417/12
5,063,775 A * 11/1991 Walker et al. ..... 73/152.31
6,442,955 B1 * 9/2002 Oakner et al. ..... 62/150
6,715,994 B2 * 4/2004 Patel et al. ..... 417/12
2003/0091440 A1 * 5/2003 Patel et al. ..... 417/12
2004/0191090 A1 * 9/2004 Patel et al. ..... 417/360

* cited by examiner

*Primary Examiner*—Michael Friedhofer
*Assistant Examiner*—Lisa Klaus
(74) *Attorney, Agent, or Firm*—Dorothy S. Morse

(57) ABSTRACT

A float switch made from plastic and impervious to corrosion, with improvements over the prior art including a more responsive operation resulting from use of a wide float switch body and a closely fitting housing that allow rapid shut-off of condensate production after collection of only a very small amount of fluid, a small housing dimension for easy installation in the small areas used for air conditioning system air handlers, a removable bottom cap for easy debris removal as well as float switch body adjustment for changing conditions, a housing design that allows operation without air vent holes in the housing, and anti-rotation features that stabilize the level orientation of the float switch body needed for proper operation after installation. By its quick and reliable response, the switch promotes use and longevity of energy efficient air conditioners without concern for the increased condensate produced, protecting the environment and energy resources.

12 Claims, 6 Drawing Sheets

MULTI-PURPOSE CONDENSATE SWITCH

CROSS-REFERENCES TO RELATED APPLICATIONS

None

BACKGROUND OF THE INVENTION

1. Field of the Invention

This invention relates to liquid-level float switches used for in-line and auxiliary applications, specifically to a float switch of sturdy construction that is primarily contemplated for use in condensate collection applications, but which is also useful in other fluid transport applications. The most preferred embodiment of the present invention is small and comprises a housing with a maximum height dimension of approximately two inches and a maximum width dimension of approximately three inches, including its connecting extension/arm that is used for fluid communication with a discharge line. Also in the present invention, an adjustable float switch body is positioned for vertical movement within the housing, guided by a concentrically positioned shaft that is secured to the enlarged upper portion of the housing with fastening means, such as but not limited to a lock-nut. The amount of float switch body displacement is preferably adjustable and defined by the positions of the lock-nut and a disk-shaped bottom stop when both are secured to the shaft. It is contemplated for both the lock-nut and stop to be removably connected to the shaft so that the float switch body can be removed when needed for maintenance, inspection, and replacement purposes. The float switch body has a large surface area for enhanced buoyancy and improved responsiveness during operation, with the housing closely positioned around the float switch body and having an open bottom end that is closed by a securely affixed cap or other closure that can be easily removed to check for debris in the main or auxiliary fluid line to which it is connected. Preferably, but not limited thereto, the bottom closure is threaded and attached with an o-ring to provide a leak-resistant connection. As the upper portion of the housing is enlarged, no air vent openings are required to prevent an airlock malfunction. Alignment guides are also preferably incorporated as a part of the extension/arm to assist in obtaining a level positioning of the housing during installation for unimpeded and proper float switch body operation, and maintaining the optimal orientation during long term operation. The alignment guides can have many configurations, such as but not limited to one or more of the following, ridges, notches, pointed teeth, square teeth, a scalloped pattern in combination with complementary pointed teeth, and/or any other configuration that incrementally provides a ratcheting type of engagement for alignment and level-preserving purposes. Electrical wires extending through the top of the housing provide the electrical connection needed between the rising float switch body and a fluid producing source, so that collection of a very small amount of water in the housing as a result of hindered or clogged fluid flow in the fluid discharge line to which the housing is connected, such as but not limited to 7.5 ml or 1.5 teaspoons, is able to activate the float switch body and promptly interrupt operation of the fluid producing source. The configuration of the present invention housing that allows positioning of the bottom of the float switch body lower than the discharge line of a fluid producing system, ensures that a very small amount of collected fluid will cause the termination of fluid production by the system. Since the float switch body does not remain in contact with condensate and added maintenance fluids, and only a small amount of collected condensate triggers the switch body, it remains responsive and functional, thereby causing the air conditioning coils to last longer for release of less ozone depleting chemicals annually into the environment. The responsiveness and reliable functionality of the present invention also promotes efficient operation of higher energy rated air conditioning systems that produce a significantly larger amount of condensate due to the present invention being able to terminate the production of condensate after only a very small amount of it is collected after a blockage occurs in the discharge line. In its basic configuration the present invention float switch is ready for auxiliary use, and with the use of one or more connecting accessories, it can be readily adapted for in-line use.

2. Description of the Related Art

When air conditioning condensate and other fluids travel in discharge lines, there is often a risk of overflow or back-up into the system producing it. As a result, liquid-level float switches have been employed in-line with such discharge lines, and also in an auxiliary capacity, to shut-off the source of fluid flow into the line when the amount of fluid therein exceeds a predetermined depth. However, currently known float switches are deficient in many ways and thereby subject to malfunction, less responsive operation, more costly installation, and/or unstable installation. Overflow and condensate back-up, particularly in older systems where back-up is repeatedly encountered, can lead to corrosion of air conditioning coils, causing freon and/or other ozone damaging chemicals to be lost to the atmosphere. Many prior art float switches tend to be at risk for malfunction since they are in constant contact with the fluid in the discharge line, and subject to impaired operation as a result of such things as rust, algae, mold, and/or other debris that grows or accumulates in the discharge line over time. Also, some prior art liquid-level float switches tend to have float switch bodies that wobble relative to the shaft with which they are associated, a condition that can lead to less responsive operation or malfunction that may worsen over time. In addition, some prior art float switches are at risk for premature malfunction as a result of being made from materials that are not completely corrosion-resistant. In contrast, the present invention is made from plastic that is impervious to corrosion. Also, its float switch body is wider than those of known prior art float switches for greater water displacement, however, its housing has a small width dimension for easy installation in the tight spaces in residential construction often permitted for air handler location and the connection of condensate discharge lines. In addition, the present invention uses less water to activate electrical shut-off for a faster response time than prior art devices as the bottom portion of its float switch body sits below the discharge line, the extension/arm of the present invention housing has a ratcheting-type leveling-assist feature for the float switch body to facilitate level installation and maintenance of the established optimum orientation during its operation, no holes are needed in the housing to prevent air-lock malfunction as its housing is configured with an enlarged upper surface or bubble that provides a continuous approximately three-fourths inch water passage throughout, the float switch body does not constantly sit in water where it could malfunction due to an accumulation of algae/rust/mold/debris over time, to provide a more secure installation than prior art devices its threaded connections comprise the standard fittings used in threaded pipe connections and not the coarse hose bib threads typically used in the majority of prior art devices, and its bottom cap or other bottom closure permits easy access to the float switch body and cleanout of algae/mold/rust/debris from the housing that could otherwise cause malfunction of the float switch body. In combination with connecting accessories, the housing can be used in a variety of auxiliary applications or be installed for in-line use. Since the present invention is small and has a simple design, it uses less materials for its construction and thereby is also cost effective to make and use. Within the next few years, higher rated air conditioning units will be required by law for fuel efficiency. The large coils used therein will create more condensate. Since condensate continues to drip for ten to fifteen minutes after the air conditioning unit has been shut off, it is very important for in-line and auxiliary switches to be responsive to very small amounts of water and be subject to minimal risk of malfunction, thus having a significant positive impact on the environment. The present invention is configured to be responsive to and meet the needs of the higher rated systems, as well as those of current systems. Without a responsive condensate/fluid flow shut-off switch, air conditioning systems with a higher energy rating would more quickly encounter overflow and back-up problems and their overall efficiency would be diminished. Therefore, in addition to having a significant positive impact on the environment, by promoting efficient use of the higher energy rated air conditioning systems, widespread use of the present invention will also have a significant impact on energy savings in the United States. No condensate/fluid flow shut-off switch is known with all of the features and advantages of the present invention.

BRIEF SUMMARY OF THE INVENTION

Objectives and Advantages

The primary object of the present invention is to provide a multi-purpose float switch for auxiliary applications, which can also be adapted for in-line use, that is capable of activating an electrical signal for shutting off an associated fluid producing system when fluid flow in the main discharge line transporting fluid away from the system becomes significantly hindered or clogged and thereby poses a risk of fluid back-up into the system. A further object of this invention is to provide a float switch with a compact housing designed for prompt and cost effective installation in the close-fitting areas sometimes built to accommodate residential air conditioning air handlers, such as but not limited to air conditioning or maintenance closets that typically have a surplus space surrounding the air handler no greater that three or four inches on any one side. It is a further object of the present invention to provide a float switch that is sturdy in construction and designed for responsive and reliable operation. A further object of the present invention to provide a float switch that is capable of being securely installed in a level orientation for proper float switch body movement and will remain substantially in its optimal orientation during its entire period of use. Another object of the present invention is to provide a float switch with a float body having a bottom surface that is located in a position lower than the discharge line to which it is connected so that it will deploy to shut-off the associated fluid producing system when only a very small amount of fluid is collected in the housing surrounding it. It is an object of the present invention to provide a float switch that is protected against air-lock malfunction without the use of vent openings. A further object of this invention is to provide a float switch that is protected against malfunction from debris/mold/rust/algae in condensate/fluid discharge line. In addition, it is a further object of the present invention to provide a float switch that is made from corrosion-resistant materials that resist premature deterioration and malfunction. It is also an object of the present invention to provide a float switch that has cost-effective construction for widespread distribution and use. A further object of this invention is to provide a float switch that positively affects the environment and the conservation of energy resources by promoting air conditioner longevity and the efficient use of higher energy rated systems.

As described herein, properly manufactured and installed, the present invention would provide a float switch that is prepared for use in an auxiliary or dead end discharge line connected to a fluid producing system, such as but not limited to air conditioning systems, to promptly shut-off that system in response to only a small amount of the fluid being diverted from the system's main discharge line and into the auxiliary line as a result of fluid flow in the main discharge line becoming significantly hindered or clogged, such as with algae, mold, rust, and/or other debris, and failure of any switch device in the main discharge line to shut down the system and avert the fluid back-up damage thereto that would otherwise result if the system were allowed to continue its fluid production. In the alternative, in combination with one or more connecting accessories, the present invention float switch can also be used in an in-line connection with the main discharge line, or a variety of other auxiliary fluid flow applications. The most significant advantages provided by present invention are its design and sturdy construction for reliable performance in shutting off fluid production at the first signs of impaired fluid flow, when only a small amount of fluid (as low as approximately 7.5 mls) has been diverted into its housing. Such a capability will become increasingly important as more energy-efficient air conditioning systems, which generate more condensate than existing systems, are more commonly employed for residential and commercial use. The structure of the present invention housing and extension/arm causes the bottom of the float switch body inside its housing to be positioned lower than the discharge line to which it is connected, resulting in a capability for its float switch body to react to fluid flow impairment situations when only a small amount of fluid is diverted into the housing. No other switch for similar applications is known to have the same structure or capability. The most preferred embodiment of the present invention is small and comprises a housing with a maximum width dimension of approximately three inches, including its connecting extension member or arm. A float switch body is positioned for vertical movement within the housing, and guided in that movement by a concentrically positioned shaft that is secured to the top of the housing. The amount of float switch body displacement needed to active a shut-off signal to stop fluid production is defined by an upper lock-nut and a disk-shaped bottom stop that are both connected to the shaft and are adjusted according to need upon installation, which makes the present invention float switch readily adaptable to a wide variety of applications and changing needs by simple recalibration of the amount of float switch body displacement. The float switch body has a large surface area for enhanced buoyancy and improved responsiveness during operation, with the housing closely positioned around the float switch body and having an open bottom end that is closed by a securely affixed cap or other closure that can be easily removed and replaced during checks for debris/rust/algae/mold in the condensate/fluid discharge line to which it is connected. Preferably, but not limited thereto, the cap or other closure used has a threaded connection and is further secured in its leak-resistant connection with an o-ring. Although the cross-sectional configuration of the present invention housing and float switch body must complement one another to minimize the amount of collected fluid required for float switch activation, the actual configuration of both may be other than circular, and include but not be limited to an ellipse, square, hexagonal, octagonal, pentagonal, non-equilateral polygon, irregular polygon, and the like. A slight bubble or enlargement in the upper portion of the housing allows sufficient fluid/condensate flow to prevent air-lock malfunction without the need for air vent openings in the housing. The extension/arm in the most preferred embodiment of the present invention, which outwardly extends from the housing and is used for connection and fluid communication with a discharge line, also has a widened upper end to assist in preventing air-lock malfunction and further has ratchet-like alignment guides configured to assist an installer in obtaining a level positioning of the housing for proper float switch body operation. Electrical wires extending through the top of the at least partially hollow present invention shaft provide the electrical connection needed with the fluid producing system so that the signal activated by the rise of the float switch body in response to a predetermined amount of fluid collection in its surrounding housing can travel to the fluid producing system and promptly shut it off. The enlarged float switch body and close-fitting housing allow for the collection of a only very small amount of condensate/fluid, such as but not limited to 7.5 ml or 1.5 teaspoons, being required to cause deployment of the float switch body and interruption of condensate production. The present invention is typically made from plastic, and thereby impervious to corrosion, which in combination with its sturdy construction avoids premature deterioration and continued operation for an extended period of time.

Although the description herein provides preferred embodiments of the present invention, it should not be construed as limiting its scope. For example, variations in the height and diameter of the housing, bottom closure, float switch body, and shaft used; the size and number of threads used on the upper portion of the shaft for housing connection; the length of the extension/arm depending from the housing; the perimeter configuration and dimension of the lock-nut used to tighten the shaft to the housing; the perimeter configuration of the bottom cap or other closure relative to the housing; and the number and spacing of protrusions on the outside surface of the bottom cap or other closure used to facilitate hand manipulation during installation and removal of the closure, if any; in addition to those variations shown and described herein, may be incorporated into the present invention. Thus, the scope of the present invention should be determined by the appended claims and their legal equivalents, rather than being limited to the examples given.

DETAILED DESCRIPTION OF THE INVENTION

Figure 1:
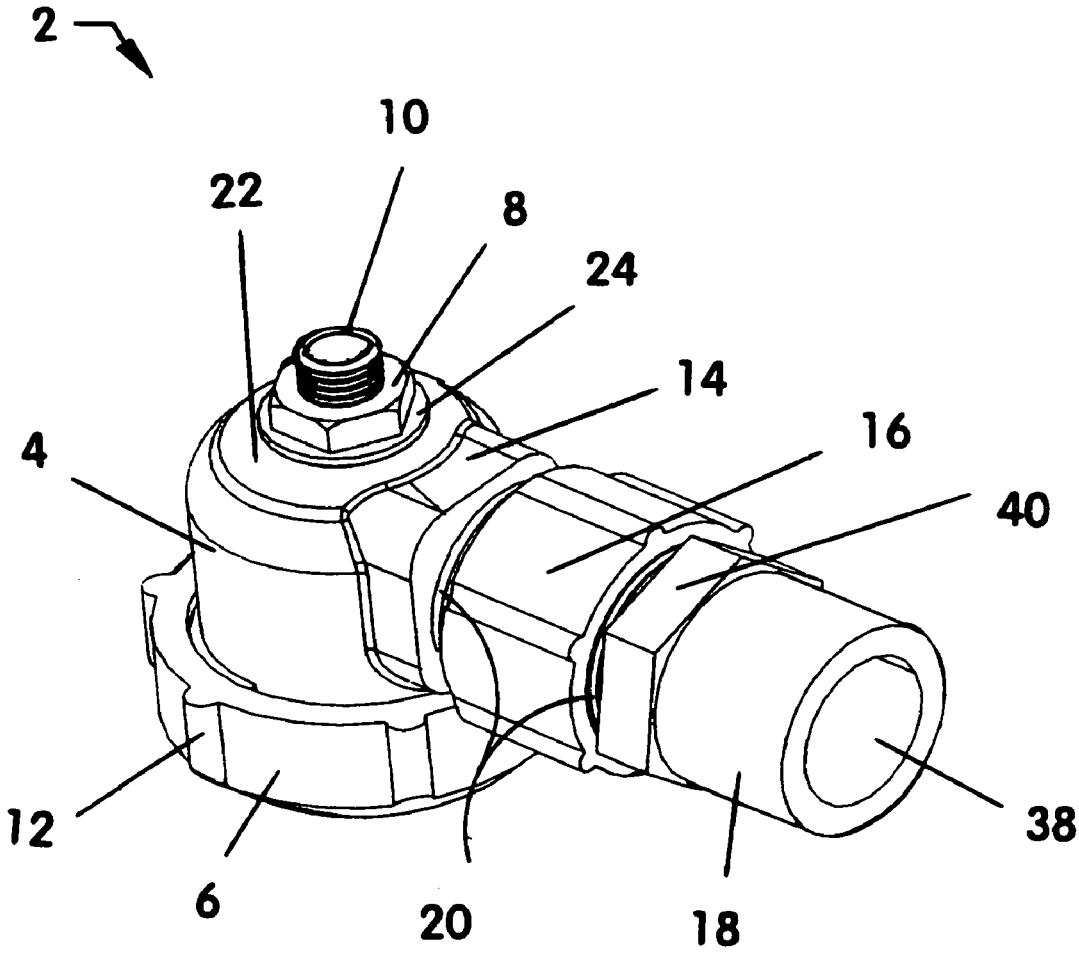
FIG. 1 is a perspective view of the most preferred embodiment switch assembly of the present invention in an assembled condition and having a housing with an enlarged upper portion, a first type of bottom cap, a vertically-oriented shaft with an upper threaded portion that is secured centrally to the top of the housing by a lock-nut, an extension/arm that is widened at its top end, and a first connecting accessory that is intended for use in installing the most preferred embodiment in auxiliary applications, with the first connecting accessory being shown attached to the housing by a threaded sleeve.
Figure 2:
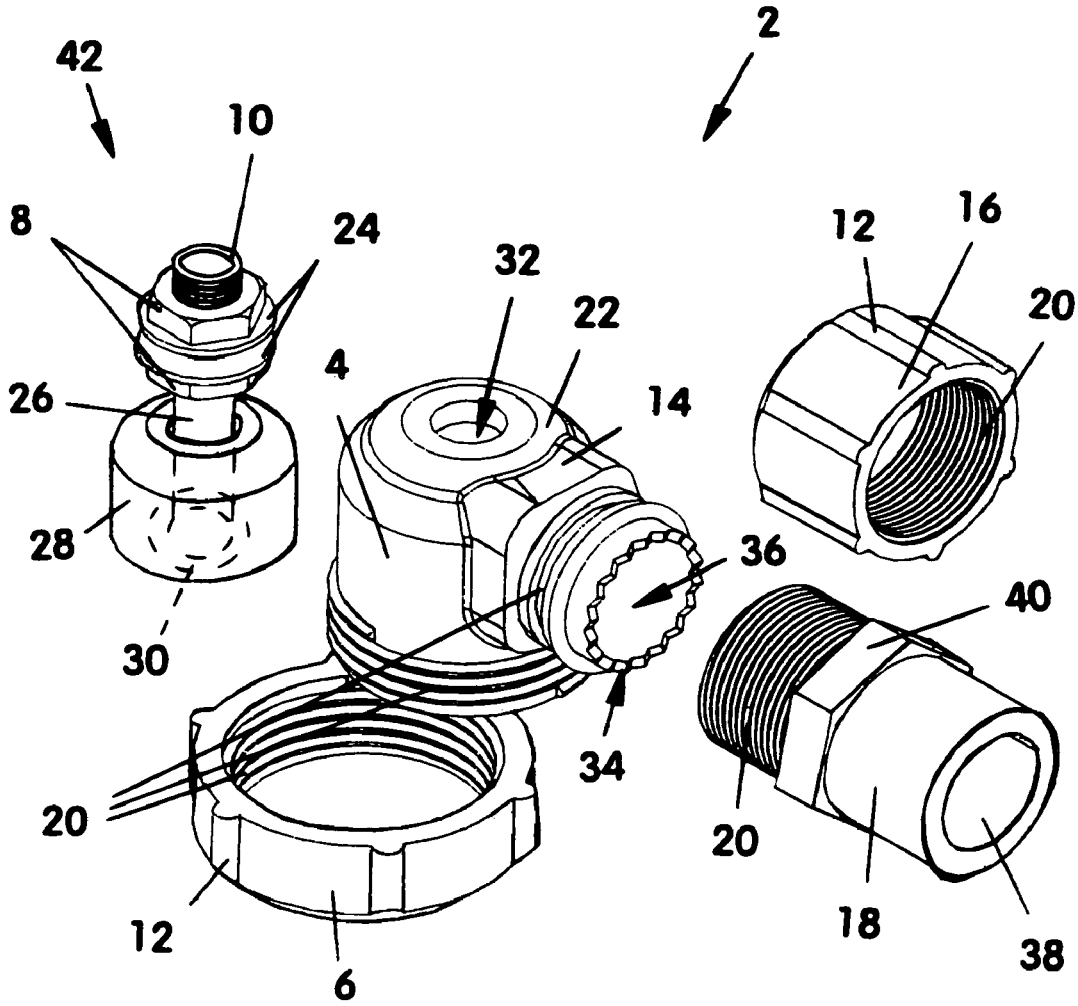
FIG. 2 is an exploded view of the most preferred embodiment switch assembly of the present invention having a housing with an enlarged upper portion and float leveling means, a threaded bottom cap, a vertically-oriented shaft with an attached float switch body and lock-nuts, the housing also having an extension/arm that is widened at its top end, the first connecting accessory used for attaching the housing to an auxiliary condensate discharge line, and a threaded sleeve used for attaching the distal end of the extension/arm of the housing to the connecting accessory.
Figure 3:
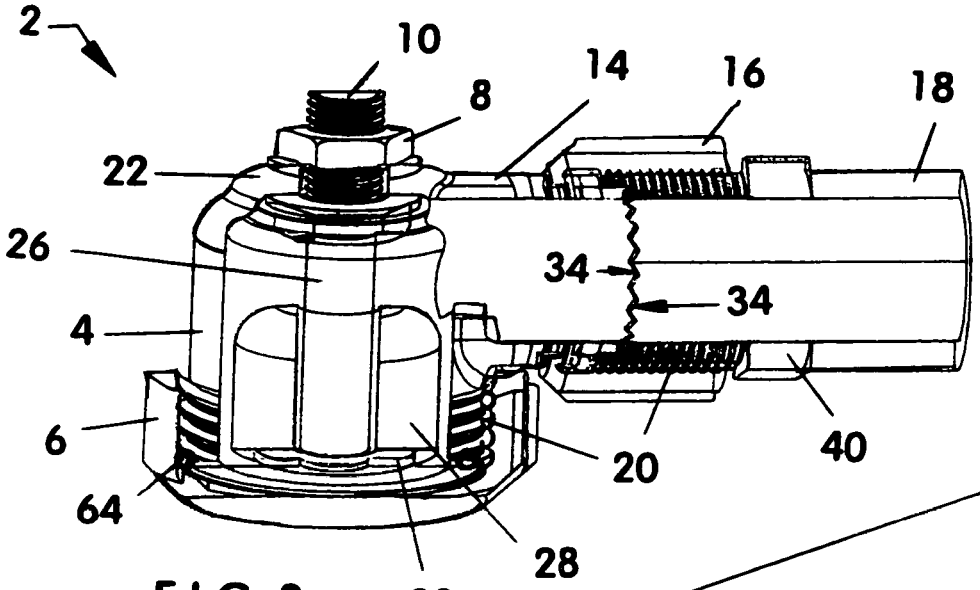
FIG. 3 is a sectioned view of the most preferred embodiment switch assembly of the present invention having a housing with an enlarged upper portion and float leveling means, a threaded bottom cap, a vertically-oriented shaft with an attached float switch body and lock-nuts securing the shaft centrally to the top of the housing, and the connecting accessory used for attaching the housing to an auxiliary condensate discharge line attached to the distal end of the extension/arm of the housing via a threaded sleeve.

FIGS. 1–3 show the most preferred embodiment 2 of the present invention multi-purpose switch, with FIG. 1 showing it assembled, FIG. 2 showing it in an exploded view for a more detailed view of each component, and FIG. 3 showing most preferred embodiment 2 in cross-section. While FIGS. 1–12 show various connection accessories that are used with the most preferred embodiment 2 of the present invention, it is to be understood that many variations in the present invention are possible and also considered to be a part of the invention disclosed herein, even though such variations are not specifically mentioned or shown. As a result, a reader should determine the scope of the present invention by the appended claims.

In the assembled condition shown in FIG. 1, most preferred embodiment 2 is ready for connection to an auxiliary fluid discharge line (not shown). In the alternative, most preferred embodiment 2 can be adapted for in-line installation in a main fluid discharge line (not shown) by use of a connecting accessory, such as but not limited to the connecting accessory 50 shown in FIG. 10. Most preferred embodiment 2 has a housing 4 with an open bottom end (not separately numbered but shown in FIG. 3) and an enlarged upper portion 22, a first style of bottom closure for housing 4 in the form of a bottom cap 6, and a vertically-oriented shaft (identified by the number 26 in FIG. 2) with an upper threaded portion 10 that is secured centrally to the top of housing 4 by a lock-nut 8 and washer 24. As shown in FIG. 3, a float switch assembly (referred to in FIG. 4 by the number 42) is positioned within housing 4 and concentric thereto, with float switch assembly 42 having a movable float switch body 28 concentric to shaft 26 and guided by shaft 26 for vertical movement in response to depth changes in the amount of fluid accumulated in housing 4. A disk-shaped stop (shown in FIG. 3 by the number 30) is attached to the lower end of shaft 26 to prevent the float switch body 28 from becoming separated from shaft 26 during use and maintain the pre-determined amount of vertical displacement through which float switch body must move to activate a shut-off signal to terminate fluid production. Stop 30 and lock-nut 8 can be used during installation to adjust the amount of vertical displacement of float switch body 28 relative to shaft 26 in each application required to send a signal to the fluid producing system to terminate fluid production. However, for removal, inspection, and/or replacement of float switch body 28, stop 30 is configured and sufficiently flexible so that it can be promptly and easily removed from and reattached to shaft 26. Although not shown, it is contemplated after installation for a pair of electrical wires to extend upwardly through the top opening in the upper threaded portion 10 of shaft 26 and be used to electrically connect most preferred embodiment 2 to the system responsible for fluid flow in the discharge line to which most preferred embodiment 2 is connected. Thus when fluid flow through the main discharge line of the fluid producing system to which most preferred embodiment 2 is connected becomes impaired, fluid will be diverted into housing 4 and cause float switch body 28 to rise, and when a pre-determined amount of fluid accumulates in housing 4 sufficient to pose a risk of fluid back-up damage into the connected fluid producing system, the elevated float switch body 28 will cause a system shut-off signal to be produced.

FIG. 1 further shows housing 4 having a laterally depending extension/arm (identified in FIG. 2 by the number 36), the upper end 14 of which is widened so that no air venting holes are needed to prevent air lock malfunction of float switch body 28. As shown in FIGS. 2 and 3, the end of extension 36 remote from housing 4 has an externally threaded configuration 20, and beyond the threaded configuration 20 both FIGS. 2 and 3 show a ratchet-like configuration of leveling ridges 34 that are used to assist in leveling float switch body 28 for proper and responsive operation. The leveling ridges 34, which can include but are not limited to ridges, teeth, and other configurations, have a sufficiently small structure to provide a fine leveling adjustment for housing 4 after coarse leveling adjustment takes place, which is performed visually during the manipulation of housing 4 needed to provide a watertight connection to a discharge line. Further, attached to the threaded configuration 20 that is outwardly depending from extension/arm 36, FIGS. 1–3 show a first connection accessory 18 secured in its usable position by a threaded sleeve 16. The dimension and amount of threading in sleeve 16 are limited mainly by its ability to provide a watertight connection and fluid communication of extension/arm 36 with a fluid discharge line, and cost considerations. As shown in FIG. 2, first connection accessory 18 has one end with a threaded configuration 20, an opposed distal end 38 without threads, and a nut-like central configuration 40 that is used to assist an installer (not shown) in manipulating first connection accessory 18 by hand or with mechanical leverage tools (not shown) to create a water tight seal with a condensate discharge line (not shown) and also for leveling float switch body 28 for proper operation. It is contemplated for opposed distal end 38 to have a configuration and dimension to provide easy connection to the line/conduit/pipe/tubing commonly used for discharge fluid flow. Further, the threaded configuration 20 shown for the distal end of extension/arm 36, sleeve 16, and connecting accessories 18, 50, 58, and 60 are all fine threads for enhanced protection against fluid leakage. These threaded configurations 20 are visually different from the coarse threaded configurations 20 shown in FIGS. 2–4 for the connection of bottom cap 6 and closure 48 to seal the bottom open end of housing 4. As can be seen in FIG. 3, the end of connection accessory 18 having a threaded configuration 20 also contains leveling ridges 34 that are complementary to those on the distal end of extension/arm 36 depending from housing 4. Sleeve 16 and bottom cap 6 both have several exterior protrusions 12 that assist in hand and/or tool manipulation and tightening to create a watertight seal in each connection made. As shown in FIG. 3, it is also preferred that an o-ring 64 be used with cap 6 to further seal it against fluid leakage. Although not shown, it is contemplated for other sealing means, such as but not limited to flat washers, to be used with bottom cap 6, however, the use of an o-ring 64 is preferred. In addition, FIG. 2 shows the central upper opening 32 through the enlarged upper portion 22 of housing 4 that is used for connection of shaft 26 to housing 4 and connection of electrical wires (not shown) to an associated fluid producing system (not shown).

Figure 4:
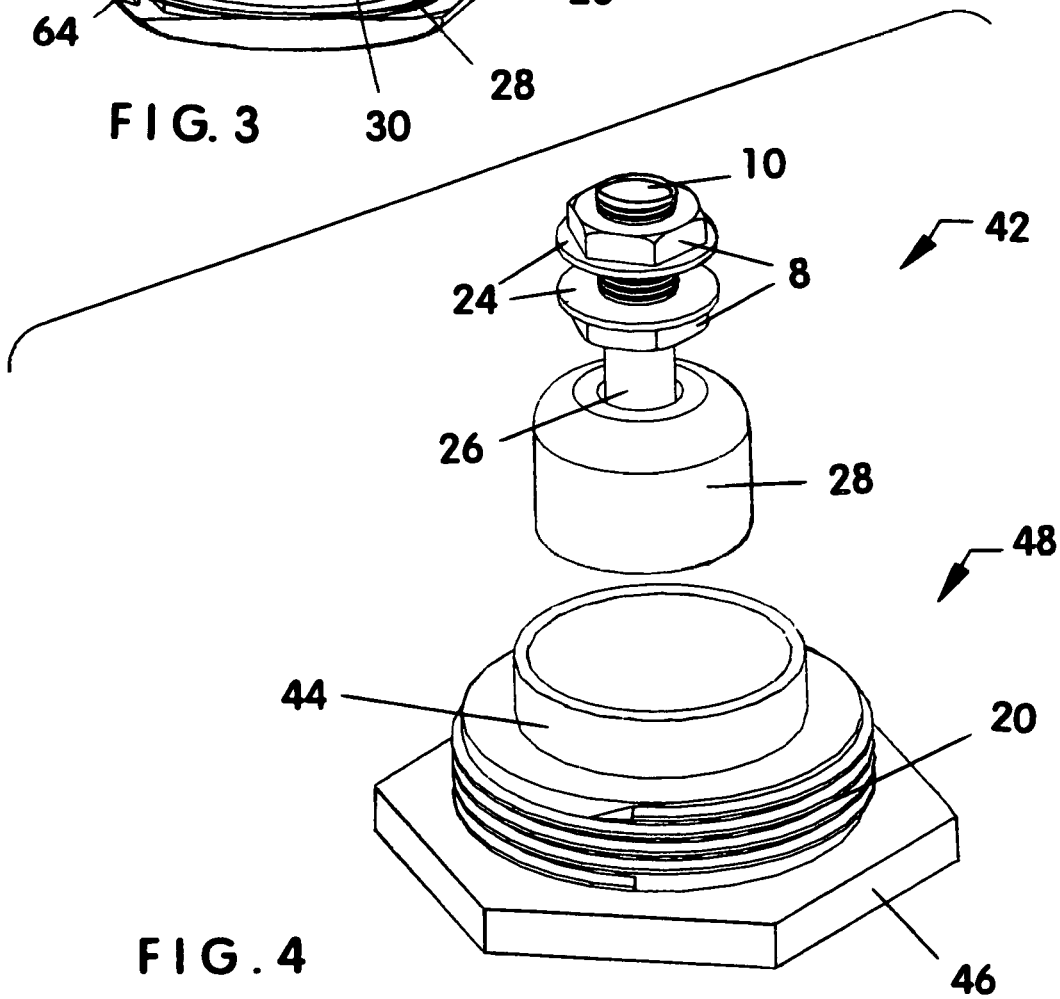
FIG. 4 is a perspective view of a second type of bottom cap used with the most preferred embodiment of the present invention switch assembly, shown with a male threaded configuration and an upwardly extending wall.

FIGS. 4–12 show a second type of bottom cap 42 for housing 4 and several connecting accessories for use in auxiliary and in-line applications of present invention housing 4 and the float switch body 28 contained therein. Although FIGS. 5–12 show a few connection accessories used with the most preferred embodiment 2 of the present invention to adapt it to a wide variety of existing discharge line configurations, it is to be understood that other departures therefrom are possible and also considered to be a part of the invention disclosed herein, even though not specifically mentioned or shown. Similarly, other closure configurations for sealing the open bottom end of housing 4 are also possible and considered to be within the scope of the invention FIG. 4 shows a second type of bottom closure 48 used with the most preferred present invention housing 4 to seal its bottom opening (not identified by a number, but visible in FIG. 3). Closure 48 has a male threaded configuration 20 separating an inner wall 44 from a base 46 that remains external to housing 4 during use. Base 46 has a preferred nut-like configuration that for tool-assisted connection to housing 4, although hand-manipulation is also contemplated for attachment of closure 48 to housing 4. The configuration of base 46 is not limited to that shown in FIG. 4, but should not be too big so as to not to restrict the positioning of housing 4 in locations where installation space is limited. When closure 48 is connected to housing 4, float switch body 28 is positioned centrally within inner wall 44, which protects float switch body 28 from constant contact with condensate (not shown) and exposed to a risk of deterioration and/or malfunction as a result thereof. Thus, as shown in FIG. 4, threaded configuration 20 has a greater diameter than inner wall 44, and base 46 typically extends laterally beyond threaded configuration 20 to provide facilitated manipulation with a hand or tool (not shown). Although illustrations have been provided for two means of sealing the open bottom end of housing 4, bottom cap 6 and closure 48, they have been provided only as examples and it is contemplated for the scope of the present invention to include any closure means, threaded, snap-on, latched, or other, of any internal or external configuration, that provides a secure and watertight seal for housing 4, does not interfere with the vertical movement of float switch body 26, and does not significantly enlarge the amount or depth of water required to activate or deploy float switch body 26 for shutting off fluid production.

Figure 5:
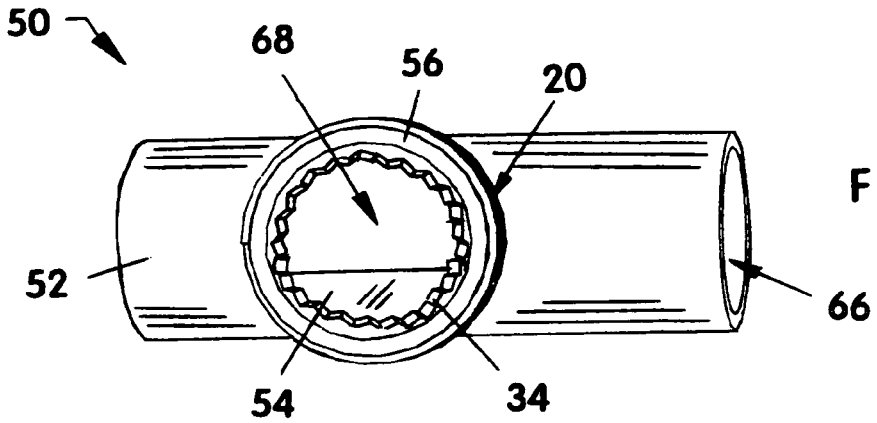
FIG. 5 is a perspective view of a preferred embodiment of a second connecting accessory used with the most preferred embodiment of the present invention switch assembly to convert it from auxiliary use to in-line applications, with the second connecting accessory having a tubular configuration with opposed end openings and a housing attachment arm centrally depending from the tubular configuration and perpendicular thereto, the housing attachment arm having a third opening, a distal end with a threaded configuration, leveling ridges also on the distal end of the housing attachment arm that are configured to mate with similar ridges on the distal end of the extension/arm of the switch assembly housing, and a wall between the housing attachment arm and the tubular configuration that separates the float switch body from the main condensate flow during routine operation in in-line applications to protect the float switch body from premature deterioration and malfunction.
Figure 6:
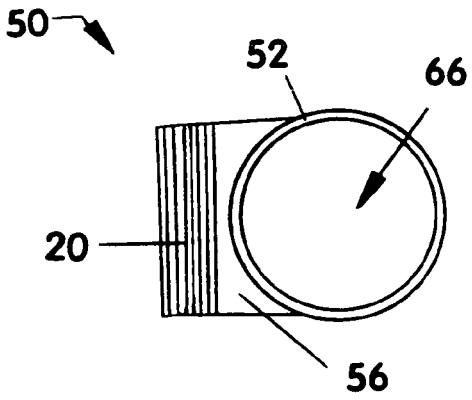
FIG. 6 is an end view of the second connecting accessory having a tubular configuration of substantially uniform interior dimension and a housing attachment arm centrally depending from the tubular configuration and perpendicular thereto, the housing attachment arm having a distal end with a threaded configuration.
Figure 7:
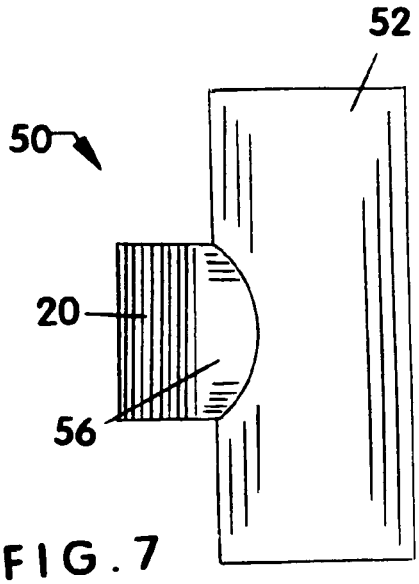
FIG. 7 is a top view of the second connecting accessory having a tubular configuration of substantially uniform exterior dimension and a housing attachment arm centrally depending from the tubular configuration and perpendicular thereto, the housing attachment arm having a distal end with a threaded configuration.

FIGS. 5–7 show a preferred embodiment of a second connecting accessory 50 used with the most preferred embodiment 2 of the present invention switch assembly to convert it from auxiliary use to in-line applications. FIG. 1 shows second connecting accessory 50 having a tubular configuration 52 with opposed end openings 66 and a housing attachment arm 56 centrally depending from tubular configuration 52 and perpendicular thereto. The housing attachment arm 56 has a third opening 68 for fluid communication between housing 4 and a condensate discharge line (not shown), a distal end with a threaded configuration 20, leveling ridges 34 on its distal end that are configured to mate with similar ridges 34 on the distal end of the extension/arm 36 that depends from housing 4, and a wall 54 positioned between the housing attachment arm 56 and the tubular configuration 52 that separates the float switch body 28 and shaft 26 within housing 4 from the main condensate flow during routine operation in in-line applications to protect the float switch body 28 and shaft 26 from premature deterioration and float switch body 28 from malfunction. The height of wall 54 is fixed during manufacture according to the intended application. FIGS. 6 and 7 each show second connecting accessory 50 with tubular configuration 56 rotated at ninety degrees from the position shown for it in the other illustration. FIG. 6 shows the tubular configuration 52 of second connecting accessory 50 having a substantially uniform interior dimension and a housing attachment arm 56 centrally depending from tubular configuration 52 and perpendicular thereto. FIG. 2 also shows housing attachment arm 56 having a distal end with a threaded configuration 20. Similarly, FIG. 7 shows second connecting accessory 50 having a tubular configuration 52 of substantially uniform exterior dimension.

Figure 8:
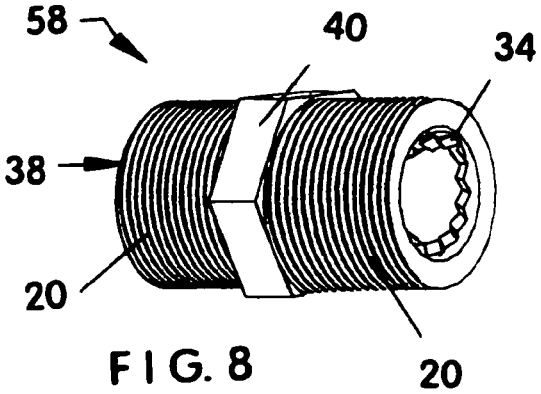
FIG. 8 is a perspective view of a third connecting accessory used with the most preferred embodiment of the present invention switch assembly in auxiliary applications and having male threads on each end for use in connecting the switch assembly to a condensate discharge line.
Figure 9:
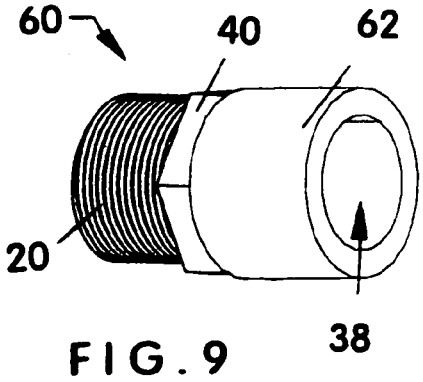
FIG. 9 is a perspective view of a fourth connecting accessory used with the most preferred embodiment of the present invention switch assembly in auxiliary applications, the fourth connecting accessory having a threaded end and an enlarged female end in an opposed position for use in connecting the switch assembly to a condensate discharge line.

FIGS. 8 and 9 show two other connecting accessories used for installation of housing 4 in auxiliary applications, respectively identified by the numbers 58 and 60. FIG. 8 shows a third connecting accessory 58 having a male threaded configuration 20 on each end for use in connecting housing 4 to a condensate discharge line. FIG. 9 shows a fourth connecting accessory 60 having an end with a male threaded configuration 20 for attachment to housing 4, with its opposing end being non-threaded and providing an enlarged female configuration 62 used for connection to a condensate discharge line (not shown). It is contemplated for third connecting accessory 58 and fourth connecting accessory 60 to both have leveling ridges 34. In FIG. 8 leveling ridges 34 are visible, while in FIG. 9 leveling ridges 34 are hidden within the end having a threaded configuration 20 that is pointed away from the viewer. Rigs 8 and 9 also each have a nut-like configuration 40. In FIG. 8 nut-like configuration 40 extends laterally beyond the threaded configuration 20 on both ends, while in FIG. 9 nut-like configuration 40 extends laterally beyond the threaded configuration 20 on the end connected to housing 4, but does not extend laterally beyond the end having enlarged female configuration 62.

Figure 10:
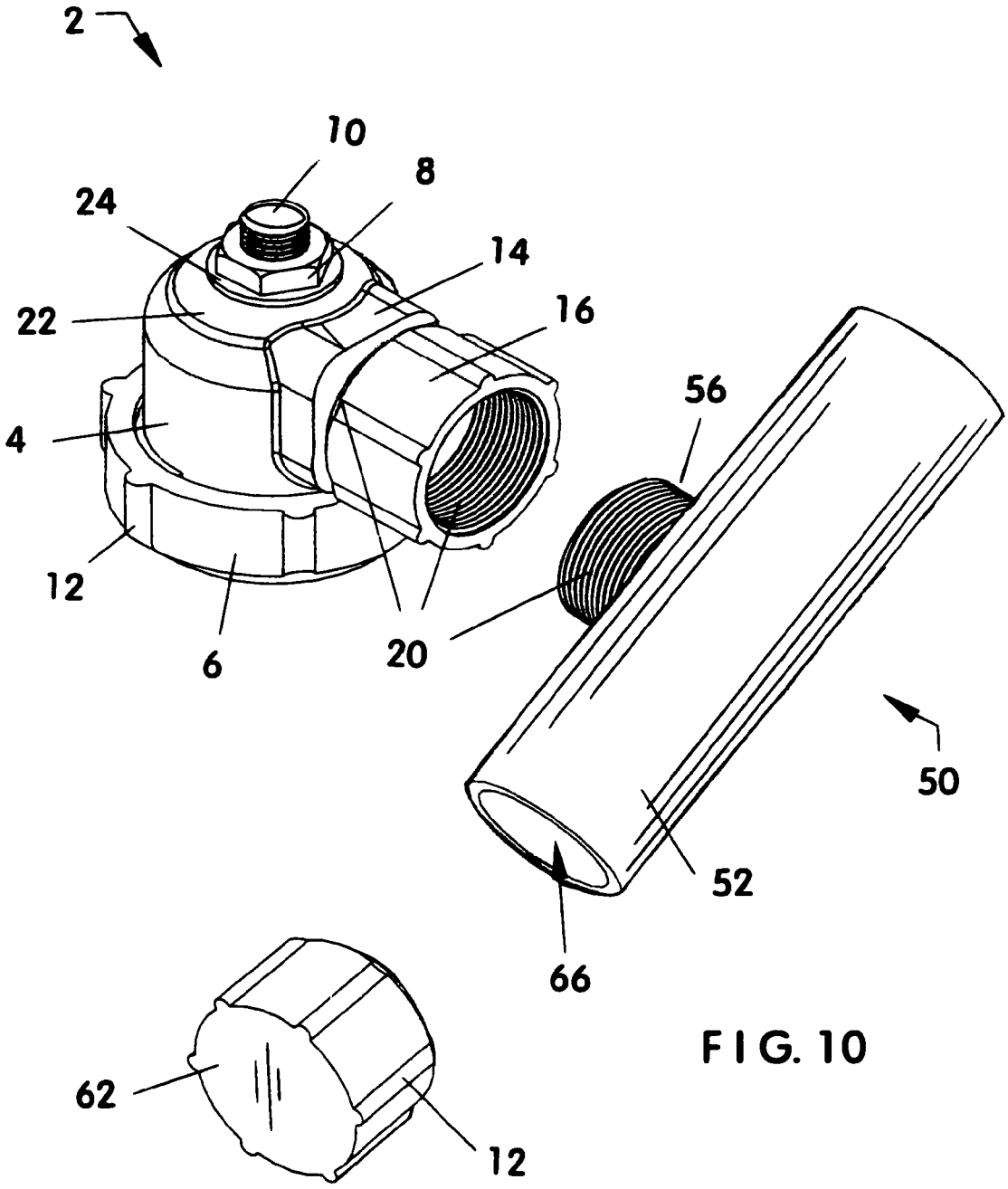
FIG. 10 is a perspective view of the second connecting accessory poised for in-line attachment of a switch assembly housing to a condensate discharge line, with a vertically extending shaft within the housing that is connected centrally to the enlarged upper portion of the housing, a first type of bottom cap secured to the bottom portion of the housing, a threaded sleeve connected to the distal end of the extension/arm depending from the housing and ready to accept the threaded distal end of the housing attachment arm of the second connecting accessory, and an end cap poised for connection to one end of the tubular member that readily adapts the switch assembly for auxiliary applications.

FIG. 10 shows an adaptation of second connecting accessory 50 to convert the most preferred embodiment 2 of the present invention from auxiliary to in-line use. The most preferred embodiment in FIG. 10 is identical to that shown in FIG. 1, with the exception of the absence of first connecting accessory 18. FIG. 10 shows the threaded configuration 20 on the housing attachment arm 56 of second connecting accessory 50 poised for attachment to housing 4 via threaded sleeve 16. When second connecting accessory 50 becomes attached to housing 4, the longitudinal axis of tubular configuration 52 is substantially perpendicular to the longitudinal axis of extension/arm 36 of housing 4 within sleeve 16. Further shown in FIG. 10 is an end cap 62 poised for connection to one end of tubular member 52 to seal it.

End cap 62 can be used with either end of tubular member 52, depending upon the application. Although FIG. 10 shows protrusions 12 on the exterior surface of end cap 62 that can be used for securing end cap 62 over one end of tubular member 52, the exterior configuration of end cap 62 may vary from that shown in FIG. 10 without departing from the intended scope of the present invention. Also, attachment of end cap 62 to tubular member 52 is not limited to a threaded connection with or without an o-ring 64 to seal it, and bonding or other agents can also be used since it is not intended for end cap 62 to be removable after installation.

Figure 11:
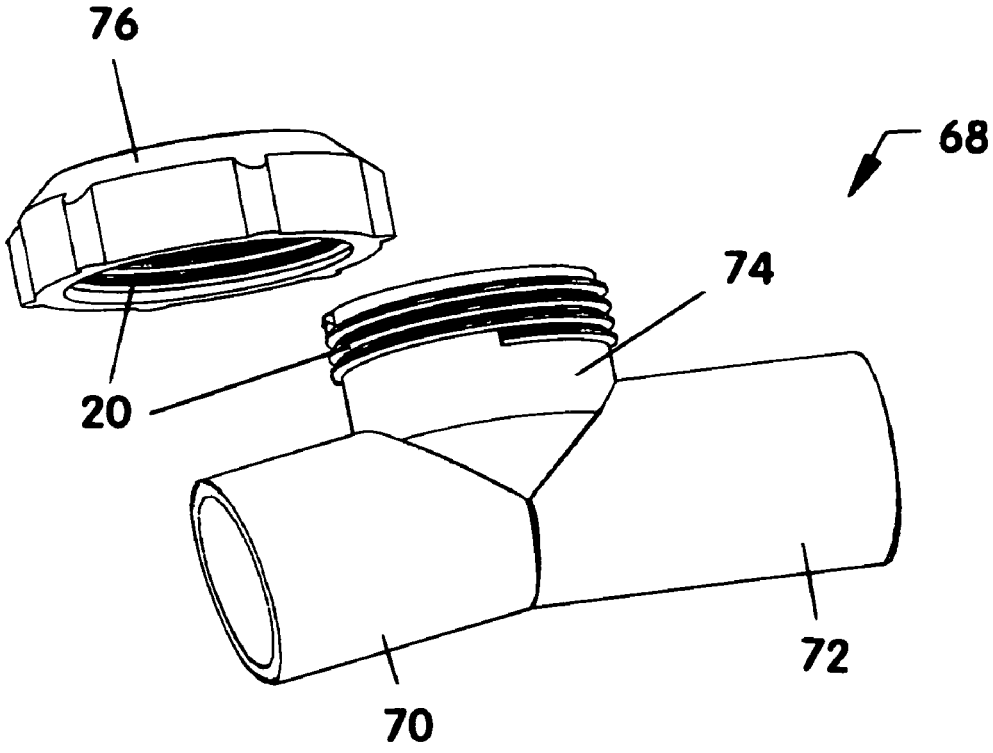
FIG. 11 is a perspective view of an angled clean-out accessory, with removable threaded cap, that also can be connected in-line to the same condensate discharge line to which the present invention switch assembly is connected, and which further diverts the gravity-assisted condensate flow away from the system generating it, as well as being used for maintenance and inspection purposes, with the angled clean-out accessory having a tubular configuration with opposed ends and one of those ends downwardly angled downwardly relative to the other, the angled clean-out accessory also having a cap attachment extension centrally and upwardly depending from the tubular configuration, as well as perpendicular thereto, the cap attachment extension having a distal end with a threaded configuration.
Figure 12:
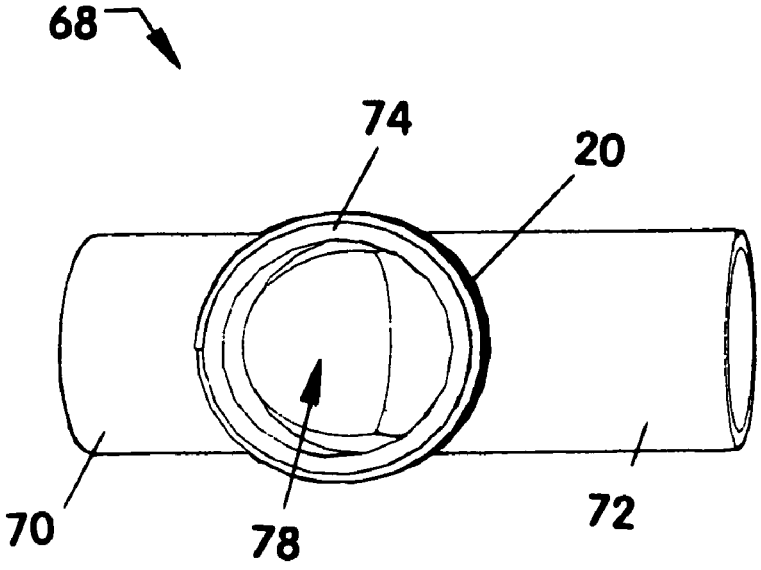
FIG. 12 is a top view of the angled clean-out accessory with its cap attachment extension having a wide opening configured for easy maintenance and inspection use.

FIGS. 11 and 12 shows an angled clean-out accessory 68 contemplated for connection in series with the float switch assembly 42 and housing 4 to a condensate discharge line (not shown). FIG. 11 shows an angled clean-out accessory 68 with a removable threaded cap 76. It is contemplated for the threaded configuration 20 on angled clean-out accessory 68, as well as on threaded cap 76, to consist of coarse threads, although not limited thereto. Angled clean-out accessory 68 can be connected in-line to the same condensate discharge line to which the present invention switch assembly is connected, and further diverts the gravity-assisted condensate flow downwardly and away from the system (not shown) generating it. In addition, angled clean-out accessory 68 can be used for maintenance and inspection purposes, with the easily removed threaded cap 76 facilitating such purposes. Further, the maintenance opening 78 through cap extension arm 74 is purposefully wide, for the spill-free addition of chemicals, when required to threaded cap 76 facilitating such purposes. Further, the maintenance opening 78 through cap extension arm 74 is purposefully wide, for the spill-free addition of chemicals, when required to control or prevent the growth algae and mold. The length dimension of cap extension arm 74 and threaded configuration 20 are not critical, unless dictated by a specific application. Angled clean-out accessory 68 has a first tubular member 70 depending from a second tubular member 72 with first tubular member 70 visibly being angled downwardly relative to second tubular member 72. Although not shown, an o-ring, such as o-ring 64 in FIG. 3, can be used with threaded cap 76 to seal it in a watertight connection with cap extension arm 74. FIG. 12 shows the top opening 78 in angled clean-out accessory 68 with its wide configuration for easy maintenance and inspection use.

The materials from which the most preferred embodiment 2 is made can vary, but must be impervious to corrosion. Preferably for cost considerations, although not limited thereto, it is contemplated for housing 4, float switch body 28, stop 30, shaft 10, and lock-nuts 8 to all be made from plastic. Resistance to UV radiation is not necessarily a contemplated feature of the present invention, unless dictated by the application. Manufacture of the present invention could be accomplished by blow molding, injection molding, assembly of pre-formed individual components, or a combination thereof, with the choice of manufacturing being determined by the anticipated purchase cost to consumers and the expected duration of use without maintenance, parts replacement, or repair. Although size of the present invention is not critical, for many condensate collection applications, the length, width, and height dimensions of the combined housing 4, bottom cap 6, and extension 36 would be less than three inches.

Prior to use of the most preferred embodiment of the present invention in an auxiliary installation, float switch body 28 would be positioned on shaft 10 so that electrical wires (not shown) extend upwardly beyond its threaded top end 10. Preferably, the upper threaded end 10 of shaft 26 would then be inserted through the central opening 32 through the enlarged upper surface 22 of housing 4 with the two lock-nuts 8 so that the remainder of shaft 26 is vertically extending through housing 4 with float switch body 28 substantially filling the interior space within housing 4. Washers 24 can also be used in association with lock-nuts 8. Stop 30 would be fixed to the bottom portion of shaft 26 to adjustably define the lower boundary of float switch body 28 displacement vertically along shaft 26 during use, with adjustment further being possible through the repositioning of lock-nuts 8. The adjustment and positioning of float switch body 28 would be governed by the application and the depth of fluid needed to cause float switch body 28 to rise and send a signal to the system producing the fluid so as to cause termination of fluid flow through the main discharge line, as well as the auxiliary line to which housing 4 is connected. To facilitate installation of housing 4 in a usable position, it is contemplated that sleeve 16 would first be attached to extension/arm 36. Thus, it is contemplated that all an operator/installer would have to do is connect an appropriate connecting accessory 18, 58, 60, 50 with an end cap 62, and/or other connecting accessory, to the auxiliary condensate discharge line, and then connect the distal end of extension/arm 36 with the assistance of sleeve 16 to the end of connecting accessory 18 and/or other accessory having a threaded configuration 20. Once housing 4 is in a secured and usable position, the installer or operator would check it for the stable and level positioning required for reliable and uninhibited vertical movement of float switch body 28. Leveling ridges 34 could be used to incrementally rotate housing 4 until shaft 26 is in a sufficiently vertical position so that float switch body 28 moves freely using shaft 26 as a guide for its up and down movement. It is important to note that in the absence of water or other fluid in housing 4, float switch body 28 is located in a position below the bottom of the discharge line, so that only a very small amount of condensate or other fluid is needed to activate it and cause it to rise to the level needed to terminate fluid production. The electrical wires (not shown) extending from the threaded top portion 10 of shaft 26 would then be connected to the system providing water, condensate or other fluid traveling through the discharge line in fluid communication with housing 4. Then, when fluid flow in the discharge line (not shown) to which housing 4 is connected becomes impeded and water or other fluid in housing 4 exceeds a predetermined level that indicates a risk of fluid back-up into the system generating the fluid as a by-product of its operation, the rising water will cause float switch body 28 to also rise and send a signal to shut off the fluid generating system. Airlock within housing 4 that could potentially interfere with the proper vertical movement of float switch body 28, is prevented by the enlarged upper portion 22 of housing 4. Minimal maintenance is contemplated. If housing 4 is made from translucent, transparent, or partially transparent materials, an operator could visibly assess the effective operation of float switch body 28 without removing it from housing 4 or separating bottom cap 6 from housing 4. The size and configuration of housing 4 connecting accessories 18, 50, 58, and 60 are not critical and can vary depending upon design and price point considerations, such as but not limited to ease of manufacture, the desirability of connection to standard connectors and fittings, and effectiveness of operation. It is further contemplated for housing 4 to have a compact design and construction for efficient packaging and transport, in addition to use in small spaces. For in-line applications, housing 4 can be secured to the housing connection arm 56 of a connecting accessory 50, the tubular configuration 52 of which has its opposed end openings 66 in fluid communication upstream and downstream with a discharge line (not shown). Connecting accessory 50 could first be connected to housing 4, then to the discharge line, or vice versa. Leveling ridges 34 on the housing connection arm 56 of a connecting accessory 50 mate with the leveling ridges 34 on extension/arm 36 to aide in the incremental positioning of housing 4 in a level orientation for proper and unimpeded movement of float switch body 28 relative to shaft 26. As with its auxiliary applications, housing 4 is positioned relative to the discharge line/pipe/conduit (not shown) so that the bottom portion of float switch body 26 is in a position lower than the bottom of the discharge pipe/conduit connected in-line with it, and the accumulation of fluid needed to cause float switch body 26 to rise and shut off the system producing fluid can be very small. The wall 54 between tubular configuration 52 and housing connection arm 56 prevents the routine flow of fluid in the discharge line/pipe/conduit from coming into contact with float switch body 26. This prevents a risk of float switch body 26 malfunction when needed, as a result of a fluid-caused deterioration of float switch body 26, or as a result of the gradual build up of algae, mold, rust, and/or other debris in the fluid traveling through the line/pipe/conduit in fluid communication with housing 4. The height of wall 54 can be manufactured according to the needs of an intended application. Further, angled clean out 68 can be used in both in-line and auxiliary applications. Thus, if an air conditioning or other condensate/fluid producing system has a main discharge line and an auxiliary line, two angled clean outs 68 can be used, one for each line. Typically, although not limited thereto, it is contemplated for angled clean outs 68 connected in in-line applications to be connected upstream from housing 4.

I claim:

1. A multi-purpose float switch assembly for use in association with an auxiliary fluid discharge line connected to a fluid producing system that also has a main fluid discharge line, to shut off the system when fluid flow in the auxiliary discharge line is impeded and poses a risk of the fluid in the main fluid discharge line backing up into the system and causing damage, said assembly comprising:

a housing having an open bottom end, an enlarged upper portion, an opening centrally through said top surface, and an extension outwardly depending from said housing with a widened upper end and distal end with a threaded configuration;

watertight closure means adapted for sealing said open bottom end of said housing;

a shaft with a threaded top portion positioned to extend through said central opening in said enlarged upper portion of said housing, fastening means adapted for removably securing said shaft to said enlarged upper portion of said housing;

a float switch body concentric with said shaft and positioned for free movement along said shaft;

stop means adapted for removable attachment to said shaft in a position lower than the discharge line and maintaining said float switch body on said shaft by blocking downward movement of said float switch body beyond the position where said stop means is attached to said shaft; and whereby the amount of upward vertical movement of said float switch body needed to activate a signal for shutting off the fluid producing system in fluid communication with said system is adjusted with said fastening means and said stop means so that when electrical wires are connected between said float switch body and the fluid producing system, and a predetermined level of fluid accumulates in said housing sufficient to elevate said float switch body and cause a signal to be sent via the electrical wires to the fluid producing system, the system is shut off and the risk of damage to the system from fluid back up is avoided.

2. The assembly of claim 1 further comprising a connecting accessory with a hollow interior adapted for fluid communication, opposing ends, and a first leveling means attached to one of said opposing ends adapted for positioning said shaft in an upright orientation for unimpeded vertical movement of said float switch body along said shaft, and wherein said outwardly depending extension further comprises a second leveling means that is complementary in configuration to said first leveling means.

3. The assembly of claim 2 further comprising a threaded sleeve configured for secure watertight connection of said first leveling means to said second leveling means.

4. The assembly of claim 3 wherein said closure means is selected from a groups consisting of caps having female threads, closures having male threads, and closures having male threads and an inner wall.

5. The assembly of claim 2 wherein said connecting accessory is selected from a group consisting of connecting accessories having opposing ends each with a male threaded configuration, connecting accessories having one end with a male threaded configuration and an opposed end with a non-threaded configuration, connecting accessories having a central non-slip mechanical-assist tool engagement configuration adapted to facilitate rotation for threaded connection, connecting accessories having one end with a male threaded configuration and an opposed end with an enlarged non-threaded configuration, connecting accessories having more than two openings for in-line adaptation with a central threaded configuration adapted for connection to said extension on said housing, and connecting accessories having more than two openings and an end cap for auxiliary adaptation.

6. The assembly of claim 5 further comprising at least two of said connecting accessories.

7. The assembly of claim 5 further comprising a threaded sleeve configured for secure watertight connection of said first leveling means to said second leveling means, and wherein said threaded configuration on said connecting accessories, said extension, and said sleeve comprise the type of finer fittings used in standard threaded pipe connections.

8. The assembly of claim 5 wherein said non-threaded ends have a bonded connection to a discharge line.

9. The assembly of claim 1 wherein said fastening means comprises at least one lock-nut.

10. The assembly of claim 1 further comprising an o-ring configured for watertight sealing of said closure means to said housing.

11. The assembly of claim 1 wherein said shaft has a top opening configured for the passage of electrical wires.

12. The assembly of claim 1 further comprising an angled clean-out accessory configured for in series connection with said assembly in a fluid discharge line, said angled clean-out accessory having an enlarged threaded opening configured for the additional of fluids therethrough without the need for a funnel to prevent airlock that blocks fluid entry, said angled clean-out accessory also having an easily removable closure means for said enlarged threaded opening.

* * * * *